US006212796B1

(12) United States Patent
Kubelka

(10) Patent No.: US 6,212,796 B1
(45) **Date of Patent: *Apr. 10, 2001**

(54) ICE-SKATING BOOT WITH OPTIMIZED UPPER SHAPE

(75) Inventor: Axel Kubelka, Obdach (AT)

(73) Assignee: MRK Handels AG, Zurich (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/117,033

(22) PCT Filed: Jan. 24, 1997

(86) PCT No.: PCT/AT97/00010

§ 371 Date: Dec. 14, 1998

§ 102(e) Date: Dec. 14, 1998

(87) PCT Pub. No.: WO97/26947

PCT Pub. Date: Jul. 31, 1997

(30) Foreign Application Priority Data

Jan. 24, 1996 (AT) ..... A113/96

(51) Int. Cl.[7] ..... A43B 23/00; A43B 5/04
(52) U.S. Cl. ..... 36/50.1; 36/88; 36/115
(58) Field of Search ..... 36/88, 89, 50.1, 36/115; 280/11.12, 11.19, 11.36, 11.22, 11.23

(56) References Cited

U.S. PATENT DOCUMENTS

| | | | | |
|---|---|---|---|---|
| 2,326,776 | * | 8/1943 | Gellman | 36/50.1 |
| 2,444,428 | * | 7/1948 | Carrier | 36/89 |
| 2,617,207 | * | 11/1952 | Jennett | 36/89 |
| 3,537,716 | * | 11/1970 | Norgiel | 36/115 |
| 3,659,361 | * | 5/1972 | White | 36/115 |
| 4,533,342 | | 8/1985 | Miranti, Jr. et al. . | |
| 4,655,465 | * | 4/1987 | Schaeffer | 36/115 |
| 4,780,969 | | 11/1988 | White, Jr. . | |
| 4,835,885 | * | 6/1989 | Hoshizaki et al. | 36/115 |
| 4,876,806 | | 10/1989 | Robinson et al. . | |
| 4,972,613 | | 11/1990 | Loveder . | |
| 5,371,957 | | 12/1994 | Gaudio . | |
| 5,784,809 | * | 7/1998 | McDonald | 36/115 |

FOREIGN PATENT DOCUMENTS

| | | | | |
|---|---|---|---|---|
| 181 838 | | 11/1898 | (CH) . | |
| 2606800 | * | 8/1977 | (DE) | 36/89 |

* cited by examiner

*Primary Examiner*—M. D. Patterson
(74) *Attorney, Agent, or Firm*—Finnegan Henderson Farabow Garrett & Dunner, L.L.P.

(57) ABSTRACT

An ice-skate having a high shoe upper part, in particular in the area of sport, requires an increased spatial requirement for the ankle in the event of a pronounced forwards inclined movement. Therefore, it is recommended to form the closure edges in the upper shaft region so as to protrude in a convex manner in the direction of the foot middle plane, in order to increase the size of the surface and to place forward the closure parts in order to change the pulling effect thereof. Furthermore, lining or padding can be provided in the region of the extensions.

4 Claims, 5 Drawing Sheets

Figure 1A:
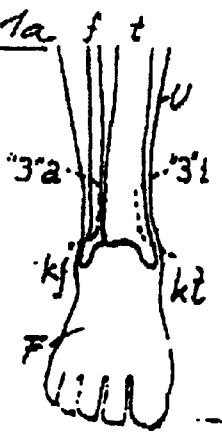

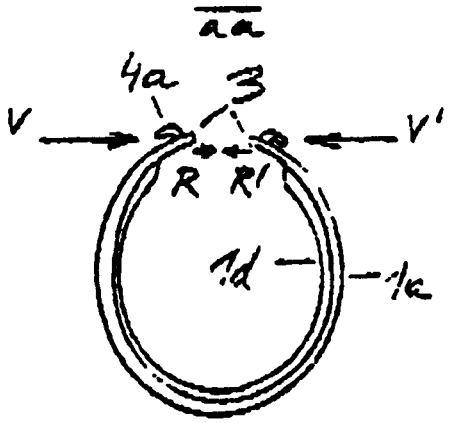
Fig. 4
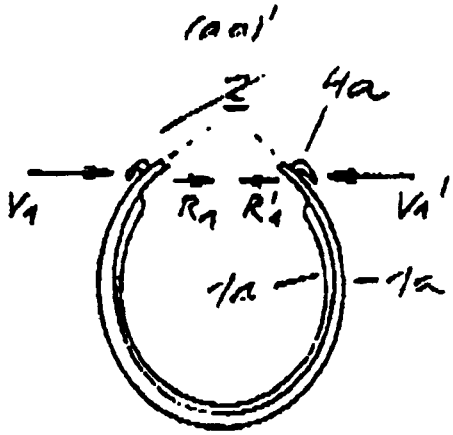
Fig. 4a
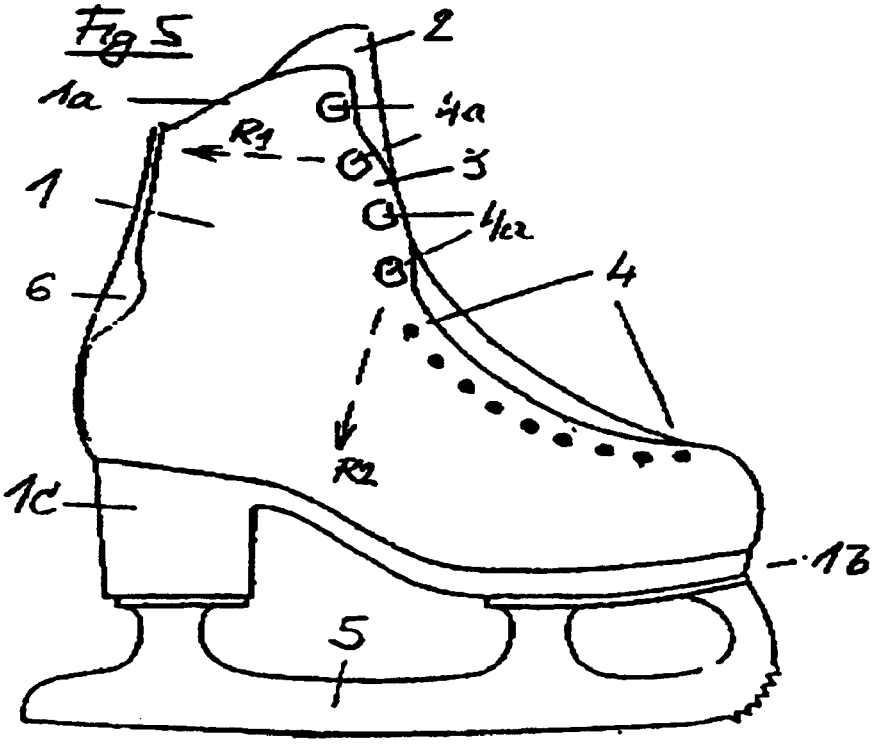

2
1a
6b
4
4b
3
7f
4b
6u
4
8
7a'
1
7a
K
1b
5

ICE-SKATING BOOT WITH OPTIMIZED UPPER SHAPE

The present invention relates to an ice-skate having a high shoe upper part made from leather, textiles, synthetic materials, metal or net structures, which comprises a foot insertion opening which extends substantially in parallel with the foot middle plane.

In the case of high shoes of conventional tongue-design and lacing, in particular in the area of sport, on the one hand relatively rigid upper parts are used and on the other hand the soles are completely rigid owing to the attachment of a device (ice-skate/roller skate/ski-boot). Even if the edges of the foot insertion opening are cut relatively widely, this does not adequately suit the spatial requirements in the ankle region, because the straight-cut edges open extremely wide apart from each other thus in the event of a forwards inclined movement unpleasant to painful pressure of the relatively hard edges is exerted upon the arch of the instep—and owing to material stress—the pressure on the ankle also increases.

In the case of leather, which even in a reinforced design assumes the shape of the user's foot and is therefore in demand, the ankle region thus tends gradually to become floppy and folded, whereby the danger of injury is increased, on the other hand it is only possible to use the old lacing-up method, because each other method would cause even earlier material fatigue owing to lever forces.

The reason for this behaviour resides not only in the fact that the foot bones, in the proximity of the ankle, spread out but also in the fact that the outline of the ankle bone is trapezoidal in shape—spread out in a forwards direction—and thus drives apart the ankles as soon as the forward lean position is taken up. In the case of a trained athlete there is therefore an increased spatial requirement for the ankle, on the one hand because he/she is more powerfully built, on the other hand takes up the forward lean position more frequently. In the case of ice-skates for figure skating the sole is also cambered to an increased extent caused by the heels of the skate, which essentially causes the ankle to lean forward.

Many efforts have been made without success in order to remedy this lack of fit, such as additional lacing or reinforcements, or incisions at the lacing edges. Since these measures did not increase space, they acted either in a blocking manner or in such a manner as to cause material fatigue because excessive flexion was provided.

U.S. Pat. No. 5,371,957 discloses a construction, wherein particularly the tab 22A, applied on to rigid leather, would only cause unnecessary pressure, at least owing to its edge formation. In the case of a possible attachment beyond the curvature 3, 4 or the holes thereof (FIG. 2, 2*a*) this would cause pain in the case of leather material. The allowance does not show any improved surface formation, which can be applied when the entire upper part consists of a solid material.

In the case of the design in U.S. Pat. No. 4,780,969 with the aim of a specific division of pulling force, the pull on the strips at the uppermost shoe edge is localised in the narrowest position and therefore a pressure site would also be produced in the event that the ice-skate consists of a rigid material. Furthermore, this design does not correspond to a formation or distribution which requires space with respect to pressure relief.

The precurvatures [not illustrated in detail] of U.S. Pat. No. 4,876,806 relate only to the front part of the foot or instep region and do not permit any spherical adaptation. The latter also applies to the precurvatures in the region of the numeral 30 of FIG. 1 of U.S. Pat. No. 4,972,613. The sleeve of the last-named document would also cause unnecessary pressure owing to the edge formation and also does not illustrate any improvement in the surface formation which can be applied when the entire upper part consists of a solid material.

The object of the wave-like structure of U.S. Pat. No. 4,533,342 is merely to overcome spatial problems and first and foremost relates merely to the front part of the foot. CH 181 838 A describes a high ice-skate having lacing, wherein the iron fitting of the skate, i.e. the runner, can be adjusted against the skate in a transverse and longitudinal direction, so that it is possible to make an optimum adaptation to suit the skater, e.g. also with respect to the centroidal axis. The ice-skate does not display any other particular aspects which are of interest here.

The object of the present invention is to provide an ice-skate with an improved fit, wherein the above described obvious spatial problems can be solved. This solution should be as convenient as possible and should be able to be produced in a cost-effective manner whilst still using current production methods.

On the basis of an ice-skate of the type mentioned in the introduction, this object is achieved by virtue of the fact that the edging of the foot insertion opening, in the region directly above the ankle joint, comprises at least on one side, preferably on both sides, a convex arcuate extension which is directed to the foot middle plane, and that this extension is engaged upon by a closure means for the skate. In a similar manner to the case of cartographic spheroid developments, it is not only an improved surface adaptation which is produced thereby in an advantageous manner, the increase in material also allows an improved rounded bend, whereby the pressure upon the ankle and the closure strips decreases.

Preferably, a closure means for the shoe acts upon this extension. In so doing, the pulling force upon the lacing-up edges causes tangential and fewer radial resulting closing forces, which also causes a relief in pressure.

In the case of a preferred embodiment of the ice-skate in accordance with the invention, the extension or extensions extends/extend, commencing approximately 15 mm below the shaft edge, approximately along the upper shaft third. In the case of an ice-skate, in which the closure means is lacing, which acts by way of closure parts, e.g holes or hooks, upon the skate, a preferred embodiment is provided, wherein the arcuate extensions extend on the one side from the second closure part as far as to the fourth closure part or as far as to the first closure part lying above the joint region, wherein preferably at least one closure part is disposed in the middle portion of the substantially symmetrical extension and the closure parts, which are disposed in the region of the end portions of the extension, can be disposed both within the extension or on the outside thereof. In the case of this embodiment at least one closure part (hooks, eyelets, rivets) is therefore located approximately in the middle region of the said extension, where it produces a genuinely tangential pulling force. In contrast, further closure parts within the edge regions of the extension or on the outside thereof produce pulling lines which are directed approximately vertically and horizontally, allocated preferably to the front part of the foot and the lower leg, whereby the centre of movement is localised. The extensions are dimensioned in a manner which is suitable for practical circumstances by virtue of the fact that in the case of the design on both sides the arcuate extensions of the edges are formed so as to protrude ca. 12 mm. Furthermore, within the scope of the present invention there is the possibility that the extensions of the edges can be larger or at least overlapping to the extent that the closure parts do not prevent them from being closed.

In order to achieve an improved anatomic adaptation of the effect of the extensions, the extensions can be formed or disposed, corresponding to the anatomic characteristics and their application, in an asymmetrical manner both in the transverse and skate longitudinal direction.

It is an advantage in practice if the shaft tongue is placed under the extensions and the shaft tongue comprises for this purpose a specific lining or padding. Alternatively, the extensions can also be disposed, however, so as to lie on an inner skate or on a padding portion of a sleeve.

As the closure parts of the closure means, it is possible for example to provide eyelets, hooks, rivets, fittings, weld-on parts, stick-on parts or seam points, which are provided at least conveniently within the extensions. Likewise, in order to improve the effect, in accordance with the invention, of the extensions, it can be provided that the said extensions are at least partially covered by a congruent strip or sleeve part extension, which takes over sections of the closure parts or comprises its own additional closure parts.

The inner surfaces of the extensions can comprise linings at least at the site, where no closure parts are provided. Furthermore, within the scope of the present invention, there is the possibility that the extensions terminate at least in the lower region at a transverse gap of the closure edge or become same, in order to reinforce the effect of the extensions. It is possible to adapt the extensions in an improved manner by virtue of the fact that for the purpose of individual adaptation the extensions are formed in an adjustable manner by virtue of toothings, eccentrics or a screw-connection and for this purpose comprise simultaneously displaceable or elastic inner lining or padding.

Figure 1:
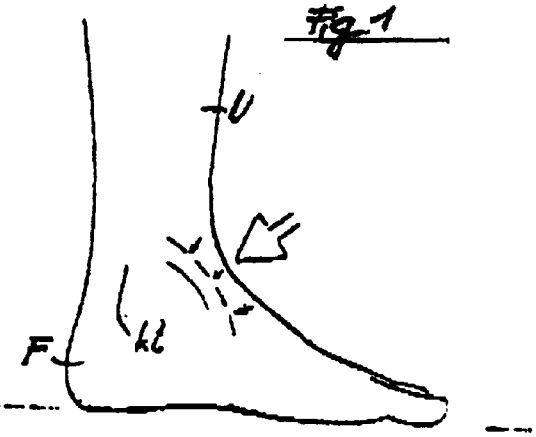
Figure 2A:
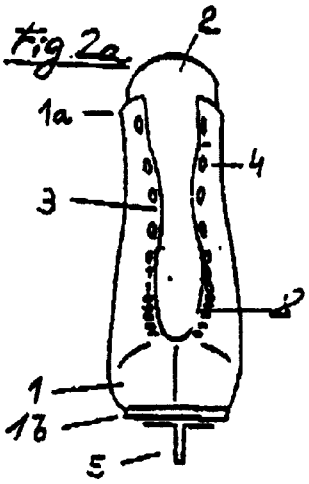
Figure 2:
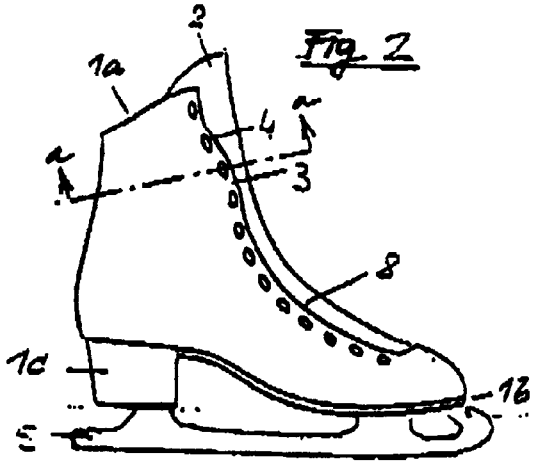
Figure 3:
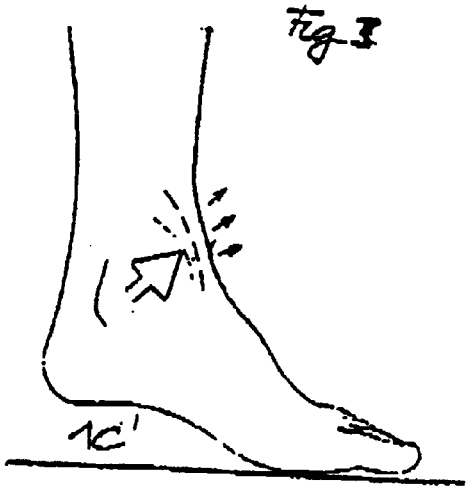

A detailed explanation of the present invention and further advantages and features of the present invention are evident in the description hereinunder of some non-limiting exemplified embodiments, wherein reference is made to the accompanying FIGS. 1 to 10, in which FIG. 1 shows a lateral view of a foot, FIG. 1*a* shows the foot of FIG. 1*a*[sic] in a front view, FIG. 2 shows the lateral view of an ice-skate, FIG. 2*a* shows the front view of the ice-skate of FIG. 2, FIG. 3 shows the position of the foot inside the skate of FIG. 2, FIGS. 4 and 4*a* show horizontal sectional views of skate shafts as in FIG. 2 and FIGS. 5–10 show lateral views of different embodiments of ice-skates of the type in accordance with the invention.

FIG. 1 shows the inner ankle position kt, and the affected regions (small arrows) and the inner bend of the instep above the joint. (Large arrow)

FIG. 1*a* illustrates the tibia and fibula t, f, and the inner and outer ankle extensions kf, kt, wherein the lower leg is designated by U and the foot is designated by F.

FIG. 2 shows the lateral view of an ice-skate 1 having the arcuate extensions 3, FIG. 2*a* shows the associated lateral view. The eyelets 4 in the closure strips 6 can be supplemented or replaced in the shaft 1*a* by virtue of the hooks 4*a* or other closure parts. The tongue 2 is covered by virtue of the arcuate extensions 3, the rigid sole 1*b* changes into the raised heel 1*c*, which determines the camber; instead of the iron fitting 5, it is also possible to mount a roller skate. The section aa is explained in the following FIGS. 4, 4*a*.

FIG. 3 shows the problem region (small arrows), which occurs owing to the camber 1*c*' when the leg moves forward (large arrow).

FIGS. 4, 4*a* having the shaft sections aa with the arcuate extension 3 and aa' without extensions 3' of this type show how the hooks 4*a*, lying further inside, with comprehensive lining 1*d* in the shaft 1*a*, "smooth" out pressure regions R, R' resulting from the tangential pulling forces V, V' on the closure parts.

FIG. 5 shows the synthetic material walking shoe having 4 closure hooks 4*a*, of which 3 are arranged in a symmetrical manner in the arcuate extension 3 and localize the mobility above the ankle joint. The quasi-horizontal pulling force R1 is produced in the upper edge region of the extension and the quasi-vertical pulling force R2 is produced in the lower edge region thereof.

Figure 6:
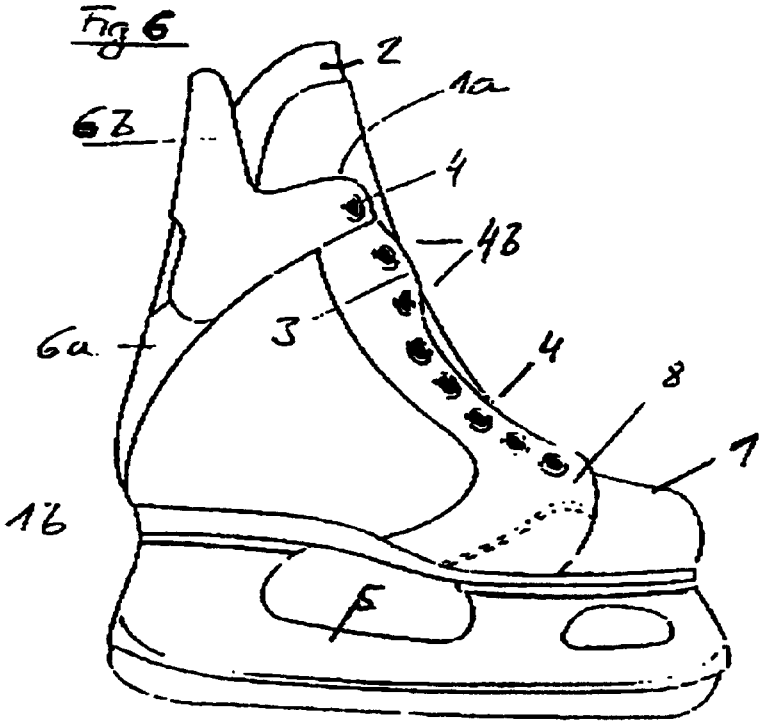

FIG. 6 shows a hockey shoe, wherein the rear reinforcement 6, separates into a lower region 6*a* and an upper region 6*b* (spoiler), and two eyelets 4*b*, quasi-symmetrical in the lacing-up strip 8 which is premachined in a radial manner so as to be congruent with the extension 3.

Figure 7:
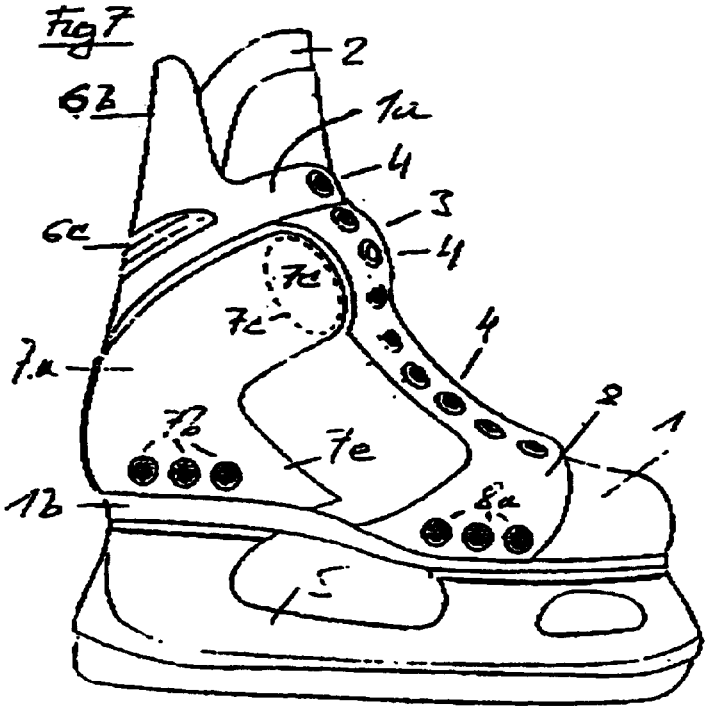
Figure 8:
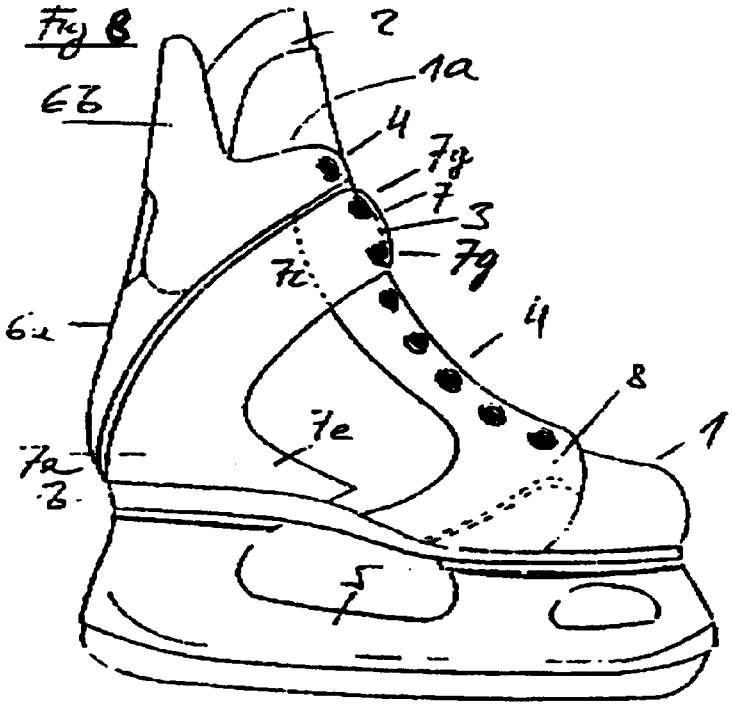

FIG. 7 shows the same with a reinforced lateral support 7*a*, which can also receive an attachment underneath, follows in a congruent manner the extension 3 and the lacing-up strip 8, and comprises furthermore a foot bed extension 7*e* and abrasion protection inserts 7*b* which are attached 8*a* to the lacing-up strip. The reinforcement is welded or stitched 7*c* directly to the shaft 1.

FIG. 6[sic] shows a rigid or flexible reinforcement 7*a*, which is connected at least to the lacing-up strip 8 or merely to the sole 1*b*, where it comprises an extension 7*e*, wherein it takes over the lacing-up eyelets 7*g* of the extension, whereas the said extension does not have to comprise any eyelets 4 in the relevant region.

Figure 9:
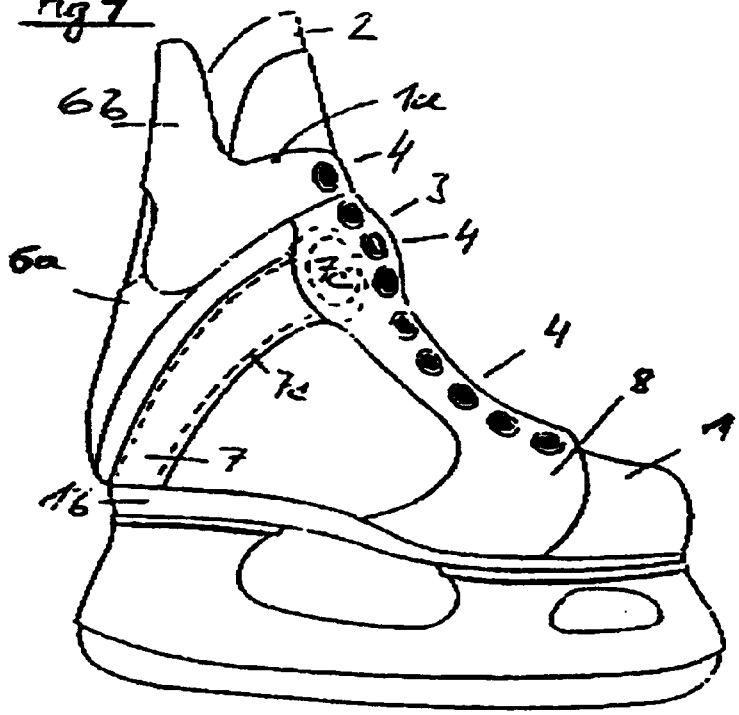

FIG. 9 shows a stitched 7*c* flexible reinforcement, connected to the lacing-up strip 8.

Figure 10:
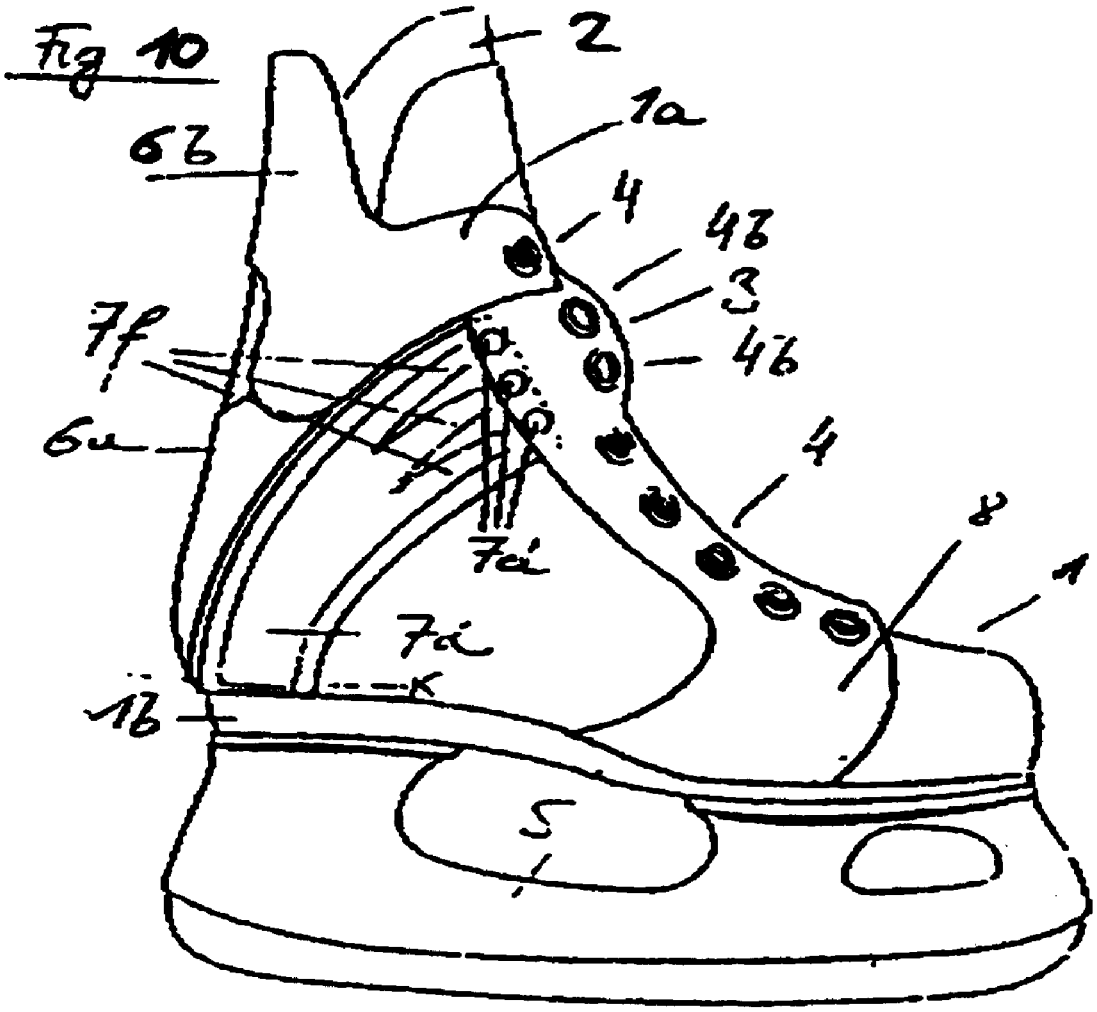

FIG. 10 shows a metal or synthetic material reinforcement 7*a* having an embossed part 7*f* which can be rivetted 7*d* to the shaft 1*a* or to the lacing-up strip.

When putting on or taking off the ice-skate, the reinforcement 7 is curved outwards over the axis "x", because it is fixed to the sole 1*b* and can be moved as soon as the closure is open.

What is claimed is:

1. An ice-skate shoe comprising:

a sole having a toe end and a heel end;

a high shoe portion connected to the sole for containing the foot of an ice skater, the high shoe portion comprising an upper end to enclose a lower leg portion of the ice-skater, an anterior side of the high shoe portion defining a longitudinal direction extending from the toe end to the upper end, the high shoe portion comprising a pair of opposed unitary continuous uninterrupted undiffferentiated edging portions extending along the longitudinal direction and extending from the toe end to the upper end to define an opening between the edging portions, the opposed edging portions each having an arcuate extension into the opening;

a plurality of closure parts formed on the pair of opposed edging portions to narrow the opening by applying a closing force to the opposed edging portions in a tangential direction normal to the longitudinal direction; and a camber member formed in association with the sole to introduce a camber on the foot at the heel end, the camber member comprising a mounting surface for receiving a skate blade.

2. The ice-skate according to claim 1, wherein said pair of arcuate extensions are provided approximately 15 millimeters from said upper end of said high shoe portion along said longitudinal direction.

3. The ice-skate according to claim 1 or 2, wherein said pair of arcuate extensions project approximately 12 millimeters from said pair of opposed edging portions along said tangential direction.

4. The ice-skate according to claim 1 or 2, wherein said pair of arcuate extensions have asymmetrical shape along said longitudinal and tangential directions.

* * * * *

UNITED STATES PATENT AND TRADEMARK OFFICE

CERTIFICATE OF CORRECTION

PATENT NO. : 6,212,796 B1
DATED : April 10, 2001
INVENTOR(S) : Axel Kubelka

It is certified that error appears in the above-identified patent and that said Letters Patent is hereby corrected as shown below:

Claim 1, column 4,
Line 40, change "undiffferentiated" to -- undifferentiated --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*